US005912216A

United States Patent [19]

Thimmappaiah et al.

[11] Patent Number: 5,912,216

[45] Date of Patent: Jun. 15, 1999

[54] RESIN BONDED ABRASIVE TOOL AND METHOD OF MAKING THE TOOL

[75] Inventors: Channarayapatna N. Thimmappaiah; Murugesan K. Kurubaran, both of Mora-NAD-Karanja, India; Gerald W. Meyer, Framingham, Mass.

[73] Assignees: Norton Company, Worcester, Mass.; Grindwell Norton Limited, Bombay, India

[21] Appl. No.: 08/964,766

[22] Filed: Nov. 5, 1997

[30] Foreign Application Priority Data

Sep. 8, 1997 [IN] India ..... 524/BOM/97

[51] Int. Cl.[6] ..... B24D 3/34

[52] U.S. Cl. ..... 51/298; 51/306

[58] Field of Search ..... 51/298, 306, 293

[56] References Cited

U.S. PATENT DOCUMENTS

| | | | |
|---|---|---|---|
| 3,592,618 | 7/1971 | Alden | 51/298 |
| 3,960,517 | 6/1976 | Ukita | 51/298 R |
| 4,475,926 | 10/1984 | Hickory | 51/298 |
| 4,500,325 | 2/1985 | Huber et al. | 51/298 |
| 4,609,381 | 9/1986 | Narayanan et al. | 51/298 |
| 4,657,563 | 4/1987 | Licht et al. | 51/308 |
| 4,877,420 | 10/1989 | Buxbaum et al. | 51/309 |

FOREIGN PATENT DOCUMENTS

| | | | |
|---|---|---|---|
| 60-242974 | 12/1985 | Japan | B24D 3/28 |
| 1308549 | 5/1978 | U.S.S.R. | C01B 7/01 |

*Primary Examiner*—Deborah Jones
*Attorney, Agent, or Firm*—Mary E. Porter

[57] ABSTRACT

A resin bonded abrasive tool consists of abrasive grain and an organic bond comprising a thermosetting resin, such as epoxy resin, phenolic resin or rubber or blends thereof and a precursor filler system capable of forming in situ an active filler system by reacting under the heat generated during grinding. The organic bond optionally further comprises a filler system. A method of making the resin bonded abrasive tool consists of mixing the abrasive grain and the organic bond with the precursor filler system, pressing the resulting mixture into shape, and curing the abrasive tool at about 150 to 200° C.

25 Claims, No Drawings

RESIN BONDED ABRASIVE TOOL AND METHOD OF MAKING THE TOOL

BACKGROUND OF THE INVENTION

This invention relates to a resin bonded abrasive tool and method of making the same.

A resin bonded abrasive tool comprises abrasive material such as fused aluminum oxide, sintered aluminum oxide, sintered sol gel microcrystalline alpha-alumina, silicon carbide, alumina zirconia, cubic boron nitride or diamond and an organic bond comprising a binder such as thermosetting resin such as epoxy resin, phenolic resin or rubber or blends thereof and a filler system. A resin bonded grinding wheel is made by mixing the abrasive material and organic bond comprising binder and filler system followed by pressing the resulting mixture into shape and typically curing the wheel at about 150 to 200° C.

A abrasive tool is used for a variety of grinding and finishing applications. The ground material may be metals such as carbon steel, low alloy steel or stainless steel or non-metals such as granite, ceramic or glass. Nearly 70 to 80% of the abrasive tools contain fused aluminum oxide abrasive and are used for grinding metals, while non-metals are ground using abrasive tools containing silicon carbide grain or diamond abrasive grain.

A variety of filler systems, such as a complex salt of manganese and potassium chloride having stoichiometry of $K_2MnCl_6$ and/or $K_4MnCl_6$, cryolite, lithopone, iron pyrites, calcium carbonate, aluminum fluoride, iron oxide or barium sulfate or blends thereof are known to be used with resin bonded abrasive tools. Such filler systems are known to enhance the grinding performance of resin bonded abrasive tools. Examples of active fillers are described in U.S. Pat. Nos. 4,500,325, 4,877,420, 4,475,926 and 4,609,381, the contents of which are hereby incorporated by reference. The filler systems undergo physical, chemical and mechanochemical reactions due to heat generated during grinding and increase the rate of grinding or cutting the workpiece and clear the chips faster thereby improving the performance of the abrasive tool and increasing the life of the abrasive tool. Such filler systems often have limitations in manufacturing and use due to chemical and/or physical instability at the operating conditions and/or handling problems. Such filler systems are also expensive. With particular reference to the complex salt of manganese and potassium chloride, it is highly hygroscopic. Therefore, abrasive tools comprising such complex salt must be kept out of contact with atmospheric air to prevent moisture formation thereon which will adversely affect the performance and life of the abrasive tools. This makes storage of such abrasive tools difficult and inconvenient. Other filler systems are also expensive or unstable, thereby rendering abrasive tools comprising the same very expensive.

An object of the invention is to provide a resin bonded abrasive tool having improved performance and increased life.

Another object of the invention is to provide a resin bonded abrasive tool which is commercially acceptable.

Another object of the invention is to provide an efficient method of making a resin bonded abrasive tool.

Another object of the invention is to provide a method of making a resin bonded abrasive tool having improved performance and increased life.

Another object of the invention is to provide a method of making a resin bonded abrasive tool which is inexpensive.

SUMMARY OF THE INVENTION

According to the invention there is provided a resin bonded abrasive tool consisting of abrasive material and an organic bond comprising a binder such as thermosetting resin such as epoxy resin, phenolic resin or rubber or blends thereof and a precursor filler system capable of reacting and forming in situ an active filler system under the heat generated during grinding, the organic bond optionally further comprising a filler system.

According to the invention there is also provided a method of making a resin bonded abrasive tool under manufacturing conditions and temperatures selected to avoid causing a reaction among the complex salt precursors. The method consists of mixing abrasive material and organic bond comprising a binder such as thermosetting resin such as epoxy resin, phenolic resin or rubber or blends thereof and a precursor filler system capable of reacting and forming in situ an active filler system under the heat generated during grinding, the organic bond optionally further comprising a filler system, the method further comprising pressing the resulting mixture into shape and typically curing the abrasive tool at about 150 to 200° C.

DESCRIPTION OF THE PREFERRED EMBODIMENTS

Abrasive tools of the invention include resin bonded grinding wheels, discs, segments and stones, as well as coated abrasive tools.

Preferred abrasive materials according to the invention include, but are not limited to, fused aluminum oxide, sintered aluminum oxide, sintered sol gel microcrystalline alpha-alumina, silicon carbide, alumina zirconia, cubic boron nitride and diamond abrasive grains, and combinations thereof. Any abrasive grain known in the art may be used in the abrasive tools of the invention.

For the active filler system, preferred precursor materials generally include those materials which are stable in the presence of the unreacted resin of the bond and in the presence of the abrasive and bond mixture during curing of the abrasive tool. Precursor materials are selected to yield an active filler system in the abrasive tool at the point of contact of the tool with the workpiece under temperature, pressure and environmental conditions existing during the grinding operation.

A preferred precursor filler system for in situ creation of a complex manganese and potassium chloride salt filler comprises 60–70% by wt potassium chloride, 15–20% by wt manganese oxide and 15–20% by wt chlorine or hydrogen chloride generating compound, and preferably 65% by wt potassium chloride, 17.5% by wt manganese oxide and 17.5% by wt chlorine or hydrogen chloride generating compound. The chlorine or hydrogen chloride generating compound preferably contains decomposable chorine, is stable at ambient condition, and is in a form suitable for use in making an abrasive tool. Preferred compounds include polyvinyl chloride (PVC), polyvinylidene chloride (Saran™) and perchloropentacyclooctene (Dechlorane Plus™; 1,2,3,4,7,8,9,10,13,13,14,14,-dodecachloro-1,4,4a,5,6,6a,7,10,10a,11,12,12a-dodecahydro-1,4:7,10-dimethanodibenzo(a,e)cyclooctene) and combinations thereof.

Additional preferred active filler systems which may be made according to the invention include, but are not limited to, cryolite ($Na_3AlF_6$), iron sulfide ($FeS_2$) and barium sulfide (BaS).

For cryolite, aluminum fluoride ($AlF_3$) and sodium fluoride (NaF) precursor materials are added to the abrasive tool and these precursors react under the heat and pressure of the grinding operation to form cryolite. Preferred quantities include 30–50 wt % aluminum fluoride and 40–70 wt % sodium fluoride. Cryolite may be formed from other precursor materials, such as aluminum fluoride ($AlF_3$), ammonium fluoride ($NH_4F$) and sodium chloride (NaCl); or sodium bifluoride and aluminum hydroxide ($Al(OH)_3$; or alkali metal fluosilicate ($Na_2SiF_6$), alumina hydrate ($Al_2O_3$—$H_2O$) and alkali metal hydroxide (NaOH); or sodium fluoride (NaF), ammonium fluoride ($NH_4F$) and sodium aluminum oxide ($NaAlO_2$).

Conditions found during grinding also will form iron sulfide from an iron oxide ($Fe_xO_y$, e.g., $Fe_3O_4$) and an organic sulfur compound (R—S) precursors in the abrasive tool. While it is believed that iron sulfide is formed in situ, the organic sulfur compound may degrade under grinding conditions to release sulfur dioxide which is believed to be the active agent evolved when iron sulfide is added as an active filler. The organic sulfur compounds preferred for use in the invention are those which are stable under conditions found during mixing and curing of the abrasive tools. Suitable organic sulfur compounds include, but are not limited to, thiazoles, such as 2-mercaptobenzothiazole and 2,2'-dibenzylthiazyl disulfide; sulfenamides, such as N-cyclohexylbenzothiazole-2-sulfenamide and morpholinylbenzothiazole-2-sulfenamide; thiurams, such as tetramethylthiuram disulfide and monosulfide, and tetraethylthylthiuram; and dithiocarbamates (or dithiocarbamic acids), such as zinc dimethyl- and zinc dibutyldithiocarbamate; and combinations thereof. Suitable iron oxides include, but are not limited to, ferrosoferric oxide, ferroferric oxide, hydrated ferric oxide and combinations thereof. Preferred amounts include 30–70 wt % iron oxide and 30–70 wt % organic sulfur compounds.

Another reaction under the heat and pressure of grinding forms barium sulfide from barium sulfate ($BaSO_4$) and a catalytic carbon material. Suitable catalytic carbon material includes, but is not limited to, carbon black, activated charcoal and graphite, and combinations thereof.

In each instance, the reaction of the precursor materials and the active filler formation occurs at the grinding interface between the tool and the workpiece. Conditions encountered at this interface typically range from about 300° to about 1000° C., and from about 100 to about 1000 p.s.i. (7.03 to 70.3 $Kg/cm^2$).

An additional benefit of the in situ formation of active filler is that the filler is formed only at the active site where it is needed. For fillers which act as a lubricant, no delivery mechanism is required because the active filler avoids thermal or mechanical damage to the workpiece and no other lubricant is needed.

It is not necessary to supply the precursor materials in stoichiometric amounts as the reactions will proceed with non-stoichiometric amounts of reactants. The precursor materials may react to form active fillers in addition to those identified herein, depending upon the nature of the materials, the abrasive grain and the bond components.

Each of these active filler precursor systems according to the invention may be present in the bond along with minor amounts of the other active filler systems or other secondary fillers as are known in the art. Suitable secondary fillers include, but are not limited to, bubble alumina, bubble mullite, glass bubbles, fluorspar, cryolite, lithophone, iron pyrites, calcium carbonate, aluminum fluoride and iron oxide, and blends thereof.

For phenolic novolac resin bonds, the abrasive tool preferably is cured at 150° to 200° C., most preferably at 175–185° C. Other resin bonds, such as epoxy bonds, modified epoxy bonds and other types of phenolic bonds, may be cured as is known and customary in the art without loss of the benefits of the invention.

Because complex salts are readily damaged by water and the like in conventional abrasive tools, these tools do not realize the full benefit of the active fillers in grinding performance. In contrast, water damage and other environmental hazards are avoided with the tools and method of the invention. Therefore, the active filler systems of abrasive tools made according to the invention perform to full capacity and the tools grind as well as, or better than, conventional tools.

The invention also makes storage of abrasive tools comprising such precursor filler system easy and convenient. Precursor components may be stored in a manufacturing facility indefinitely without the necessity of special handling to avoid moisture absorption from the environment. This reduces the cost and complexity of manufacturing abrasive tools. Precursor components used in the complex salt filler system comprise potassium chloride, manganese oxide and chlorine and are relatively inexpensive compared to the complex salt, thereby rendering an abrasive tool comprising the same inexpensive.

The following experimental examples are illustrative of the invention but do not limit the scope thereof:

EXAMPLE 1

A abrasive tool composition was prepared by mixing 745 g of fused aluminum oxide abrasive (BRR of Orient Abrasives Ltd., Porbandar, Gujarat, India) with 35 g of liquid phenolic resin (PLGW-1 of Marvel Thermosets Pvt. Ltd., Mumbai, India) and 217 g of a blend prepared by blending of 488 g of powder phenolic resin of West Coast Polymers Pvt. Ltd., Kankole, Kerala, India), 310 g of iron pyrites powder (PYROXPAT 325 of Chemetall Gmbh, Frankfurt, Germany), 37 g of manganese oxide powder, 134 g of potassium chloride powder and 33 g of polyvinyl chloride powder. A conventional abrasive tool composition (control) was prepared by mixing 748 g of the same-fused aluminum oxide abrasive with 30 g of the same liquid phenolic resin and 222 g of a blend prepared by blending 477 g of the same powder phenolic resin, 303 g of the same iron pyrites powder and 220 g of complex salt of manganese and potassium chloride (MKC-S salt (described in U.S. Pat. No. 4,877,420) of BBU Chemie GMBH, Vienna, Austria). Both compositions were molded into Type 27 grinding wheels and cured in an oven at 180° C. for about 20 hrs. The wheels had 48% by volume abrasive, 46% by volume bond and 14% by volume porosity. The wheels were tested for grinding performance in a standard angle grinder under commercial test conditions. The overall grinding performance of both the wheels was comparable.

EXAMPLE 2

A grinding wheel composition was prepared by mixing 1520 g of fused aluminum oxide abrasive (BRR of Orient Abrasives Pvt. Ltd. Porbunder, Gujarat, India) with 79 g of liquid phenolic resin (PLGW-1 of Marvel Thermosets Pvt. Ltd., Mumbai, India) and 204 g of liquid phenolic resin of short flow (PLGW-1 of Marvel Thermosets Pvt. Ltd., Mumbai, India) and 305 g of iron pyrites powder (PYROXPAT 325 of Chemetall Gmbh, Frankfurt, Germany), 37 g of manganese oxide powder, 133 g of potassium chloride powder and 33 g of polyvinyl chloride powder. A conventional grinding composition (control) was prepared by mixing 1495 g of the same fused aluminum oxide abrasive, 66 g of the same liquid phenolic resin and 200 g of the same liquid phenolic resin of short flow and 371 g of the same iron pyrites powder and 180 g of complex salt of manganese and potassium chloride (MKC-S salt of BBU, Chemie Gmbh, Vienna, Austria). Both compositions were molded into Type 1 grinding wheels with glass fibre reinforcement (350 mm diameter and 3.2 mm thickness). The wheels were cured in a oven at 180° C. for about 24 hours. The wheels had 48% by volume abrasive, 46% by volume bond and 6% by volume porosity. The wheels were tested under laboratory condition in the cutting off mode in a standard cutting off machine and the results are given in the following Table I:

TABLE 1

| Grinding Wheel Type | Work-piece Material | Cutting speed | No. of cuts | Material Removal Rate cm/min (in./min) | Wheel Wear Rate cm/min (in./min) | Power kw | Grinding Ratio |
|---|---|---|---|---|---|---|---|
| 1) Control | Steel EN 9 1.91 cm (¾") diameter | 3 sec/cut | 50 | 1.303 | 0.606 | 9–10 | 2.15 |
| 2) Invention | Steel EN 9 1.91 cm (¾") diameter | 3 sec/cut | 50 | 1.380 | 0.483 | 10–11 | 2.86 |

The Table 1 shows that the overall grinding performance of the grinding wheel of the invention was in the range of about 10 to 20% more than the conventional wheel under identical conditions. The quality of the cut pieces was comparable for both wheels.

EXAMPLE 3

Grinding wheels were made with the compositions of Example 2 as described therein but in the sizes of 400 mm diameter and 3.2 mm thickness. The wheels had the same percentage by volume abrasive, bond and porosity. The wheels were tested for cutting 38 mm diameter stainless steel bars and carbon steel bars under different cutting speeds and the results are given in the following Table II:

TABLE II

| Grinding Wheel Type | Work-piece Material | Cutting speed Secs/Cut | No. of cuts | Material Removal Rate cm/min (in./min) | Wheel Wear Rate cm/min (in./min) | Power kw | Grinding Ratio |
|---|---|---|---|---|---|---|---|
| 1) Control | Stainless Steel SS 304 3.81 cm (1.5") dia. | 1.7 | 40 | 19.33 (7.61) | 11.10 (4.37) | 20.1 | 1.74 |
| 2) Invention | Stainless Steel SS 304 3.81 cm (1.5") dia. | 1.7 | 40 | 18.85 (7.42) | 8.38 (3.30) | 19.1 | 2.25 |
| 3) Control | Stainless Steel SS 304 3.81 cm (1.5") dia. | 3.3 | 40 | 9.70 (3.82) | 3.48 (1.37) | 11.7 | 2.80 |
| 4) Invention | Stainless Steel SS 304 3.81 cm (1.5") dia. | 3.3 | 40 | 9.80 (3.86) | 3.30 (1.30) | 12.0 | 2.95 |
| 5) Control | Carbon Steel C 1018 3.81 cm (1.5") dia. | 1.7 | 34 | 18.54 (7.30) | 15.65 (6.16) | 26.2 | 1.18 |
| 6) Invention | Carbon Steel C 1018 3.81 cm (1.5") dia. | 1.7 | 38 | 18.69 (7.36) | 13.87 (5.46) | 27.2 | 1.35 |
| 7) Control | Carbon Steel C 1018 3.81 cm (1.5") dia. | 3.3 | 30 | 9.80 (3.89) | 13.13 (5.17) | 18.1 | 0.75 |

TABLE II-continued

| Grinding Wheel Type | Work-piece Material | Cutting speed Secs/Cut | No. of cuts | Material Removal Rate cm/min (in./min) | Wheel Wear Rate cm/min (in./min) | Power kw | Grinding Ratio |
|---|---|---|---|---|---|---|---|
| 8) Invention | Carbon Steel C 1018 3.81 cm (1.5") dia. | 3.3 | 30 | 10.29 (4.05) | 10.44 (4.11) | 17.3 | 0.99 |

Table II shows that the G-ratio of the wheel of the invention was in the range of about 10–20% more compared to the conventional wheel under identical conditions. The quality of cut pieces was similar for both wheels.

EXAMPLE 4

A grinding wheel composition is prepared by mixing 33.7 kg of fused aluminum oxide abrasive with 1.12 kg of liquid phenolic resin and 10.5 kg of a preblend. The preblend is made by blending 4.79 kg of powder phenolic resin, 3.66 kg of iron pyrite powder, 0.82 kg of aluminum fluoride powder and 1.24 kg of sodium fluoride powder. A conventional grinding composition (control) is prepared from 32.8 kg of the same fused aluminum oxide abrasive, 1.12 kg of the same liquid phenolic resin and 10.6 kg of a preblend prepared by blending of 4.65 kg of powder phenolic resin, 3.65 kg of the same iron pyrites powder and 2.14 kg cryolite ($Na_3AlF_6$). Both the compositions are molded into non-reinforced cut-off grinding wheels (508 mm diameter and 4.4 mm thickness). The wheels are cured in a oven at 180° C. for about 24 hours. The wheels have 50% by volume abrasive, 36% by volume bond and 14% by volume porosity. The wheels are tested under laboratory condition in the cutting off mode in a standard cutting off machine. The wheels of the invention have a grinding performance at least equal to the grinding performance of the control wheels.

EXAMPLE 5

A grinding wheel composition is prepared by mixing 35.0 kg of fused aluminum oxide abrasive with 1.16 kg of liquid phenolic resin and 9.24 kg of a preblend. The preblend is made by blending 4.95 kg of powder phenolic resin, 2.22 kg of cryolite, 0.83 kg of iron oxide ($Fe_2O_3$) powder and 1.22 kg of tetramethylthiuram disulfide. A conventional grinding composition (control) is prepared by mixing 32.8 kg of the same fused aluminum oxide abrasive, 1.12 kg of the same liquid phenolic resin and 10.6 kg of a blend prepared by blending of 4.65 kg of powder phenolic resin, 2.14 kg of the same cryolite powder and 3.65 kg iron sulfide ($FeS_2$). Both of the compositions are molded into non-reinforced cut-off grinding wheels (508 mm diameter and 4.4 mm thickness). The wheels are cured in a oven at 180° C. for about 24 hours. The wheels have 50% by volume abrasive, 36% by volume bond and 14% by volume porosity. The wheels are tested under laboratory condition in the cutting off mode in a standard cutting off machine. The wheels of the invention have a grinding performance at least equal to the grinding performance of the control wheels.

EXAMPLE 6

A grinding wheel composition is prepared by mixing 34.0 kg of fused aluminum oxide abrasive with 1.13 kg of liquid phenolic resin and 10.2 kg of a preblend. The preblend is made by blending 4.82 kg of powder phenolic resin, 2.16 kg of cryolite, 3.04 kg of barium sulfate [$Ba(SO_4)$] powder and 0.15 kg carbon black. A conventional grinding composition (control) is prepared by mixing 34.0 kg of the same fused aluminum oxide abrasive, 1.13 kg of the same liquid phenolic resin and 10.3 kg of a blend prepared by blending of 4.82 kg of powder phenolic resin, 2.16 kg of the same cryolite powder and 3.29 kg barium sulfide (BaS). Both the compositions are molded into non-reinforced cut-off grinding wheels (508 mm diameter and 4.4 mm thickness). The wheels are cured in a oven at 180° C. for about 24 hours. The wheels have 50% by volume abrasive, 36% by volume bond and 14% by volume porosity. The wheels are tested under laboratory condition in the cutting off mode in a standard cutting off machine. The wheels of the invention have a grinding performance at least equal to the grinding performance of the control wheels.

We claim:

1. A resin bonded abrasive tool consisting essentially of abrasive grain and an organic bond, the organic bond comprising a thermosetting resin binder and a precursor filler system capable of forming in situ an active filler system by reacting under the heat generated during grinding.

2. The resin bonded abrasive tool of claim 1, wherein the precursor filler system comprises 60–70% by wt potassium chloride, 15–20% by wt manganese oxide and 15–20% by wt chlorine or hydrogen chloride generating compound.

3. The resin bonded abrasive tool of claim 1, wherein the precursor filler system comprises 65% by wt potassium chloride, 17.5% by wt of manganese oxide and 17.5% by wt of a chlorine source selected from the group consisting of chlorine generating compound and hydrogen chloride generating compound, and combinations thereof.

4. The resin bonded abrasive tool of claim 3, wherein the chlorine source is selected from the group consisting of polyvinyl chloride, polyvinylidene chloride and perchloropentacyclooctene, and combinations thereof.

5. The resin bonded abrasive tool of claim 1, wherein the precursor filler system comprises 30 to 50% by wt aluminum fluoride, and 40 to 70% by wt of sodium fluoride.

6. The resin bonded abrasive tool of claim 1, wherein the precursor filler system comprises 30 to 70% by wt iron oxide, and 30 to 70% by wt of at least one organic sulfur compound.

7. The resin bonded abrasive tool of claim 6, wherein the organic sulfur compound is selected from the group consisting of thiazoles, sulfenamides, thiurams, dithiocarbamates, and combinations and derivatives thereof.

8. The resin bonded abrasive tool of claim 1, wherein the precursor filler system comprises 70 to 99.5% by wt barium sulfate, and 0.5 to 30% by wt of at least one source of catalytic carbon.

9. The resin bonded abrasive tool of claim 8, wherein the source of catalytic carbon is selected from the group consisting of carbon black, activated charcoal and graphite, and combinations thereof.

10. The resin bonded abrasive tool of claim 1 wherein the organic bond comprises a binder selected from the group consisting of epoxy resin, phenolic resin, phenolic novolac resin, rubber, modified rubber and combinations thereof.

11. The resin bonded abrasive tool of claim 1 wherein the organic bond further comprises at least one filler in addition to the active filler system.

12. The resin bonded abrasive tool of claim 1 wherein the abrasive grain is selected from the group consisting of fused aluminum oxide, sintered aluminum oxide, sintered sol gel microcrystalline alpha-alumina, silicon carbide, alumina zirconia, cubic boron nitride and diamond grains, and combinations thereof.

13. The resin bonded abrasive tool of claim 1, wherein the tool consists of 34 to 56 vol % abrasive grain, and 2 to 64 vol % organic bond.

14. The resin bonded abrasive tool of claim 13, wherein the organic bond comprises 5 to 60 vol % active filler system.

15. A method of making a resin bonded abrasive tool having an active filler system consisting of:

a) mixing abrasive grain and organic bond comprising a binder and a precursor filler system capable of forming in situ the active filler system by reacting under the heat generated during grinding, to form a uniform mixture;

b) pressing the uniform mixture into shape;

c) curing the abrasive tool at about 150 to 200° C.; and d) grinding with the cured abrasive tool at forces sufficient to generate temperatures of about 300° to 1000° C. at the grinding interface, and thereby forming the active filler system.

16. The method of claim 15, wherein the precursor filler system comprises 60–70% by wt potassium chloride, 15–20% by wt manganese oxide and 15–20% by wt chlorine or hydrogen chloride generating compound.

17. The method of claim 16, wherein the precursor filler system comprises 65% by wt potassium chloride, 17.5% by wt manganese oxide and 17.5% by wt chlorine or hydrogen chloride generating compound.

18. The method of claim 15, wherein the abrasive tool is cured at 175–185° C.

19. The method of claim 15, wherein the precursor filler system comprises 30 to 50% by wt aluminum fluoride, and 40 to 70% by wt of sodium fluoride.

20. The method of claim 15, wherein the precursor filler system comprises 30 to 70% by wt iron oxide, and 30 to 70% by wt of at least one organic sulfur compound.

21. The method of claim 20, wherein the organic sulfur compound is selected from the group consisting of thiazoles, sulfenamides, thiurams, dithiocarbamates and dithiocarbamic acids, and combinations thereof.

22. The method of claim 15, wherein the precursor filler system comprises 70 to 99.5% by wt barium sulfate, and 0.5 to 30% by wt of at least one source of catalytic carbon.

23. The method of claim 22, wherein the source of catalytic carbon is selected from the group consisting of carbon black, activated charcoal and graphite, and combinations thereof.

24. The method of claim 15, wherein the organic bond comprises a binder selected from the group consisting of epoxy resin, phenolic resin, phenolic novolac resin, rubber, modified rubber and combinations thereof.

25. The method of claim 15, wherein the organic bond comprises at least one filler in addition to the precursor filler system.

* * * * *